US011578942B2

(12) United States Patent
Tasyagan

(10) Patent No.: US 11,578,942 B2
(45) Date of Patent: Feb. 14, 2023

(54) FIRING SYSTEM IN A PRECHARGED PNEUMATIC (PCP) RIFLE

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 16/972,630

(22) PCT Filed: May 30, 2019

(86) PCT No.: PCT/TR2019/050394
§ 371 (c)(1),
(2) Date: Dec. 7, 2020

(87) PCT Pub. No.: WO2020/242398
PCT Pub. Date: Dec. 3, 2020

(65) Prior Publication Data

US 2022/0082352 A1 Mar. 17, 2022

(51) Int. Cl.
*F41B 11/00* (2013.01)
*F41B 11/723* (2013.01)

(52) U.S. Cl.
CPC ..... *F41B 11/723* (2013.01)

(58) Field of Classification Search
CPC ..... F41B 11/62; F41B 11/721; F41B 11/57; F41B 11/71; F41B 11/52; F41B 11/723; F41B 11/722; F41A 11/06; F41A 17/74
USPC ..... 124/73–77
See application file for complete search history.

(56) References Cited

U.S. PATENT DOCUMENTS 2,301,653 A * 11/1942 Wells ..... F41B 11/723 124/75
5,063,905 A * 11/1991 Farrell ..... F41B 11/721 124/72
5,477,843 A * 12/1995 Kunimoto ..... F41B 11/56 124/75
5,529,050 A * 6/1996 D'Andrade ..... F41B 11/723 124/56
5,664,552 A * 9/1997 Kunimoto ..... F41B 11/721 124/76
5,727,538 A * 3/1998 Ellis ..... F41B 11/52 124/77
6,003,504 A * 12/1999 Rice ..... F41B 11/52 124/73
6,832,605 B2 * 12/2004 Farrell ..... F41A 11/06 124/76
7,150,276 B1 * 12/2006 Rice ..... F41B 11/62 124/73
7,726,293 B2 * 6/2010 Wei ..... F41B 11/723 124/74
7,752,974 B2 * 7/2010 Wenaas ..... F41B 11/81 102/367

(Continued)

FOREIGN PATENT DOCUMENTS

KR 20060094833 6/2006

OTHER PUBLICATIONS

International Search Report of PCT/TR2019/050394, dated Jul. 14, 2020.

*Primary Examiner* — Michael D David

(74) *Attorney, Agent, or Firm* — Phil IP Law Inc.; Narek Zohrabyan; Karen Kirk Galoyan

(57) ABSTRACT

A firing system using a gas piston instead of a trigger spring provides firing by air that is released after contacting an air outlet valve needle in pre-charged pneumatic (PCP) rifles. This system results in a high outlet speed as well as rapid fire by use of a lever that limits the single release of air into the tube.

6 Claims, 5 Drawing Sheets

(56) References Cited

U.S. PATENT DOCUMENTS

Figure 1:
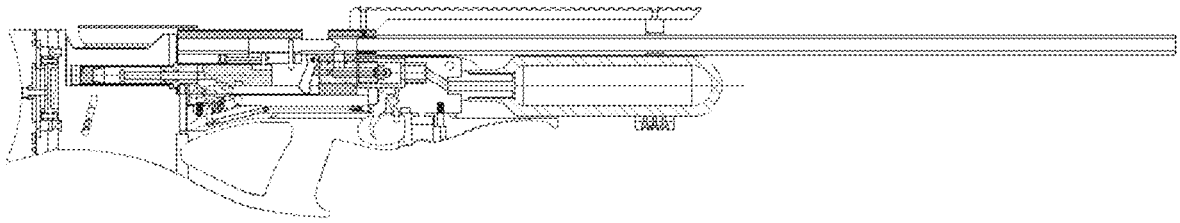

| | | | | |
|---|---|---|---|---|
| 7,882,830 | B1 * | 2/2011 | Gabrel | F41B 11/723 124/75 |
| 8,079,356 | B2 * | 12/2011 | Reible | F41B 11/57 124/82 |
| 8,082,913 | B2 * | 12/2011 | Lian | F41B 11/721 124/80 |
| 2002/0129806 | A1 | 9/2002 | Kim | |
| 2003/0226555 | A1 * | 12/2003 | Reible | F41B 11/52 124/73 |
| 2005/0011508 | A1 * | 1/2005 | Kunimoto | F41B 11/62 124/73 |
| 2010/0108049 | A1 * | 5/2010 | Dobbins | F41A 19/12 124/77 |
| 2013/0192577 | A1 * | 8/2013 | Maeda | F41B 11/723 124/74 |
| 2019/0120590 | A1 * | 4/2019 | Tasyagan | F41A 5/26 |
| 2019/0128638 | A1 | 5/2019 | Lee | |

* cited by examiner

FIRING SYSTEM IN A PRECHARGED PNEUMATIC (PCP) RIFLE

TECHNICAL FIELD

Invention relates to a firing system which is using a gas piston instead of a trigger spring. Firing is provided by air which is released after the air outlet valve needle is hit in a pre-charged pneumatic (PCP) rifle. This firing process requires high speed of outlet and allowing achievement of outlet speeds and firing numbers required by use of lever preventing at once release of air in the tube and giving high speed during firing.

PRIOR ART

In the state of the art, when setting mechanism in pre-charged pneumatic (PCP) rifles, the cocking lever drives the hammer and provides compression of a spring therein. When the trigger is pressed, the released hammer hits the air outlet valve needle with the energy gained by the hammer spring and air is released from tube and the released air provides firing pressure.

In the state of the art, hammer springs in pre-charged pneumatic (PCP) rifles are helical springs. These springs cause some problems. The energy gained by the hammer spring compression may be inadequate to reach the desired result. Spring thickness may be increased to enhance spring energy. However, in case of increasing the spring thickness, additional problems can occur because more distance is required for compression of the spring in the mechanism where springs operate.

A second problem is instability of the muzzle velocity. After using the rifle a certain number of times, because of the spring wear, outlet speed of muzzle velocity decreases and sometimes even the rifle fails to function.

Purpose of the Invention

Purpose of the invention is to achieve desired high outlet speed by gaining required compression energy by use of a gas piston instead of a helical spring used as a hammer spring and by help of a lever.

Another purpose of the invention is to eliminate the problems that might occur because of spring wear after use of rifle for a certain period of time.

Required compression energy gained by use of the gas piston is not enough to achieve desired outlet speed. When trigger is pressed, the hammer is driven and hits the air outlet valve needle and firing is achieved by the air releasing from the tube. However, impact of the hammer directly onto the needle is not enough to achieve the desired high outlet speed. A lever is thus placed before the air outlet valve needle so the hammer impacts the lever and increases the force transmitted to the outlet valve needle; thereby, a required outlet speed is achieved.

DETAILED DESCRIPTION OF THE INVENTION

Gas piston and lever developed in order to achieve the purpose of the invention are shown in the figures.

The figures are as follows:

FIG. 1: General view of parts forming firing system of PCP rifle

Figure 2:
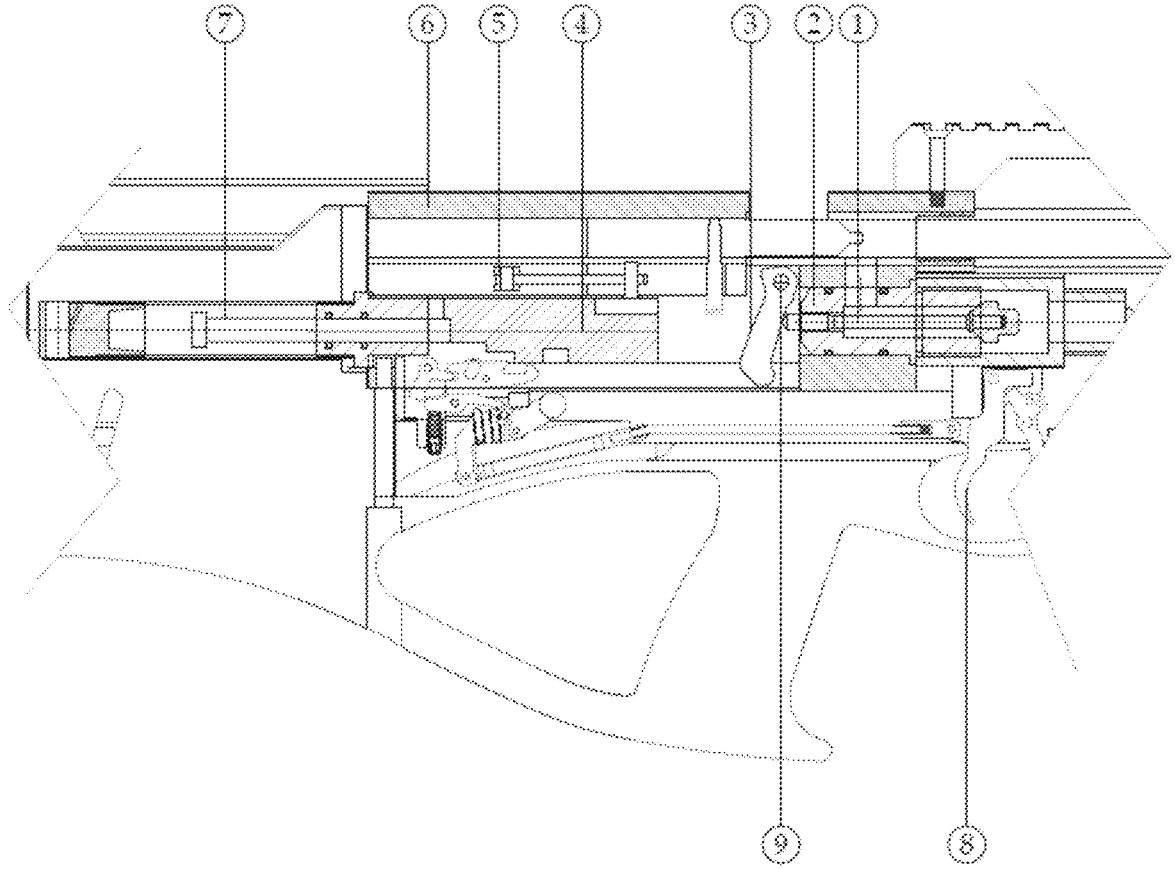

FIG. 2: Detailed view of parts forming firing system of PCP rifle

Figure 3:
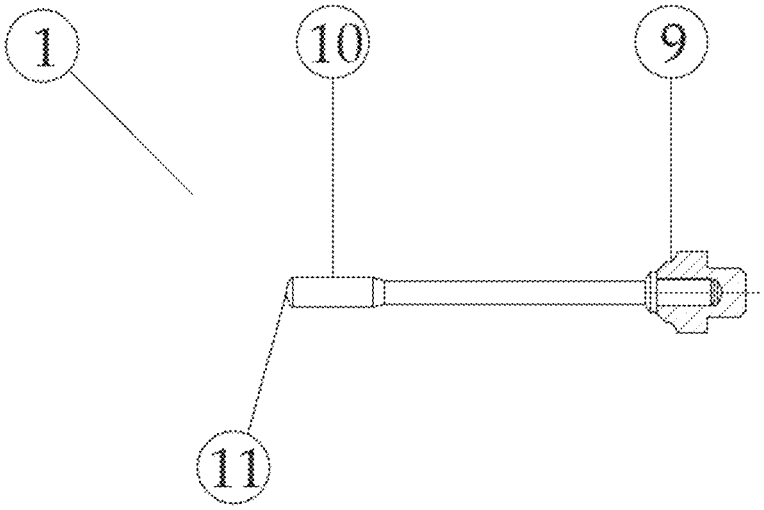

FIG. 3: Detailed view of air outlet valve needle

Figure 4:
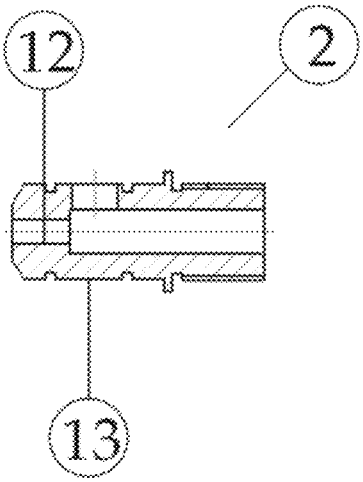

FIG. 4: Detailed view of air outlet valve body

Figure 5:
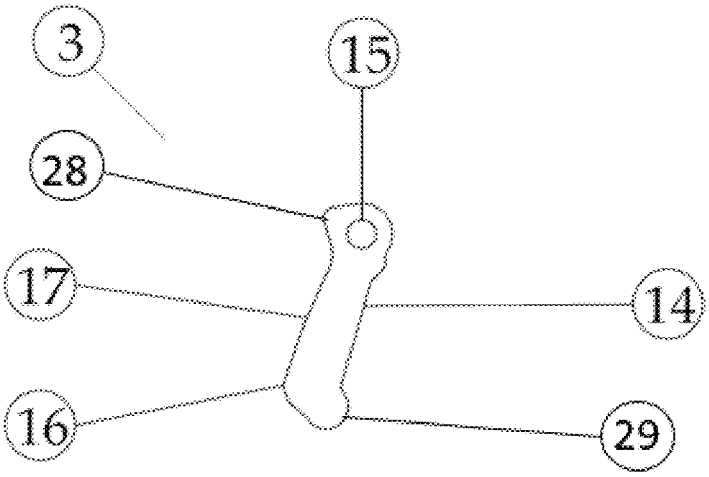

FIG. 5: Detailed view of lever

Figure 6:
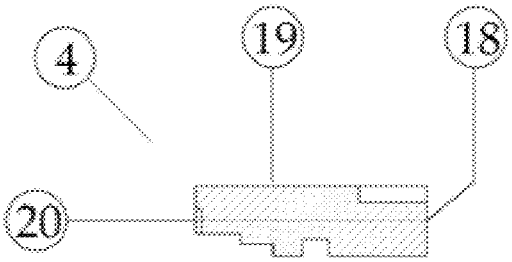

FIG. 6: Detailed view of hammer

Figure 7:
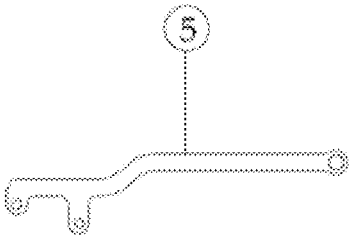

FIG. 7: Detailed view of setting arm

Figure 8:
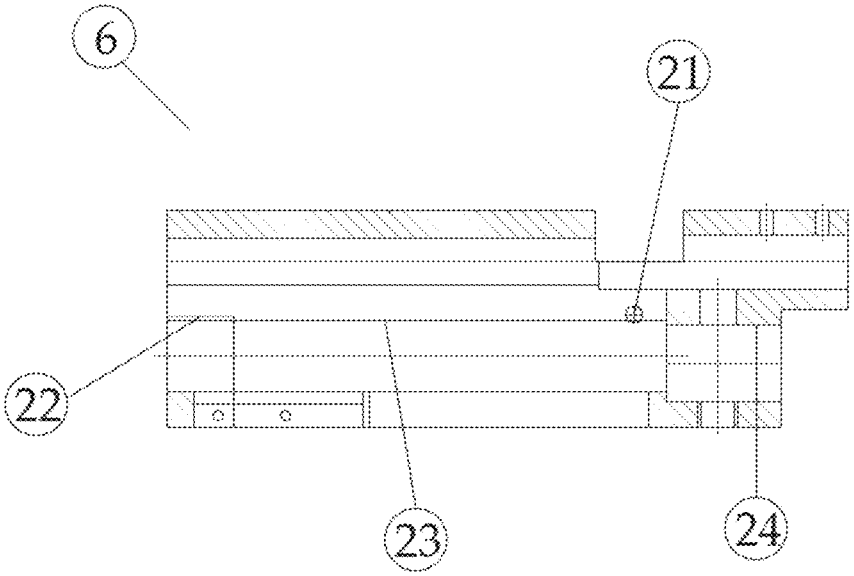

FIG. 8: Detailed view of mechanism body

Figure 9:
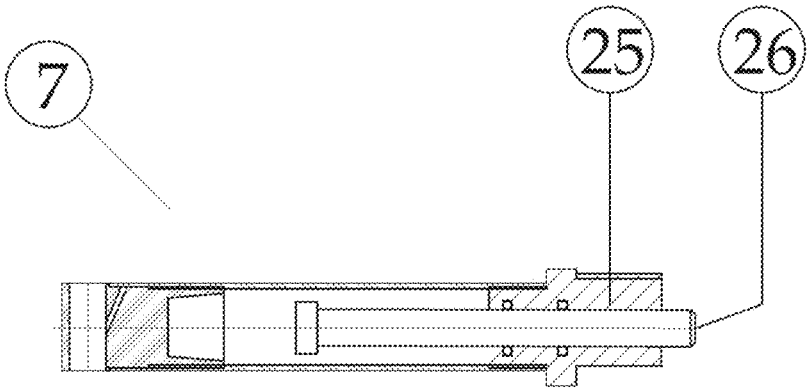

FIG. 9: Detailed view of gas piston

Figure 10:
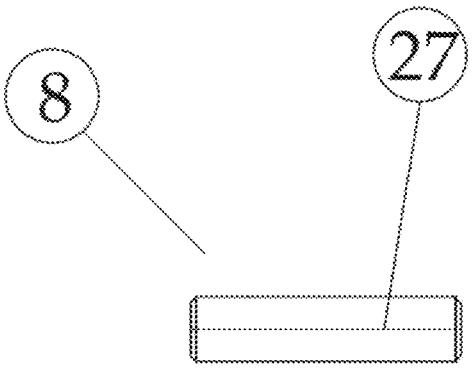

FIG. 10: Detailed view of lever fixing pin

Numbers are put on the figures in order to better understand the parts and their functions. Accordingly:

1—Air outlet valve needle
2—Air outlet valve body
3—Lever
4—Hammer
5—Set lever
6—Mechanism body
7—Gas piston
8—Fixing pin
9—Preventive surface
10—Body centering
11—Lever hitting surface
12—Needle housing
13—Valve body centering surface
14—Needle contact surface
15—Centering hole
16—Pushing surface
17—Kicking surface
18—Hitting surface
19—Hammer centering surface
20—Hammer rest surface
21—Lever fixing hole
22—Gas piston fixing chamber
23—Hammer housing
24—Valve body fixing body
25—Mechanism body fixing chamber
26—Gas piston rest surface
27—Fixing pin surface
28—Lever limiting notch
29—Needle limiting notch A general view of a pre-charged pneumatic (PCP) rifle comprising a gas piston (7), a hammer (4) and a lever (3) is disclosed in the invention as shown in FIG. 1. FIG. 2 shows detailed view of the gas piston (7), the hammer (4) and the lever (3) of the invention. After the set lever (5) shown in FIG. 7 is pulled back, the hammer (4) connected to the set lever (5) contacts the gas piston (7) at a hammer rest surface (20) and pushes the gas piston (7) spindle inside and air inside the gas piston (7) is compressed. When a trigger is pressed, compressed air in the gas piston (7) moves forward the gas piston (7) spindle (FIG. 9). Gas piston rest surface (26) which is the end part of the gas piston (7) spindle pushes the hammer (4) from the back by means of the rest surface (20) of hammer. Centering surface (19) of hammer moves linearly in a hammer housing (23) located on the mechanism body (6) such that the hammer's (4) hit surface (18) first makes contact with a pushing surface (16) in the lower part of the lever (3) (FIG. 5).

Gas piston fixing chamber (22) and mechanism body fixing chamber (25) sit onto each other. The mechanism body (6) and gas piston (7) are also connected. Lever fixing hole (21) located on mechanism body (6) and centering hole (15) located in an end part of an upper section of the lever (3) are overlapped by help of a fixing pin (8) shown in FIG. 10 and interconnected by means of fixing pin (8). Lever fixing hole (21) and centering hole (15) conduct rotating action on fixing pin surface (27). By effect of this action, lever (3) is fixed to a valve body connection chamber (24)

located on the mechanism body (6) shown in FIG. 8 by air outlet valve body (2) centering surface (13) (FIG. 4). Air outlet valve needle (1) located in a needle housing (12) is centered in the air outlet valve body (2) which moves in the plane of the body centering (10). With this pushing motion, needle contact surface (14) on the lever (3) pushes the lever hit surface (11) shown in FIG. 3 and such that the air outlet valve needle (1) and the surface (9) moves away from the lever (3) which provides a passage for air to pass through the air outlet valve body (2); thus, releasing air from the tube.

The pushing movement of the hammer (4) on the lever (3) continues until the lever (3) contacts the kicking surface (17) which is on the upper surface. The needle limiting notch (29) limits the counterclockwise pushing movement of the lever (3), thus limiting movement of the needle contact surface (14) with the air outlet valve needle (1). Hit surface (18) contacts the kicking surface (17) such that the backward force of the air outlet valve needle (1) is adequate to push back the hammer (4). If the hit surface (18) shown in FIG. 6 presses only on the push surface (16), the backward force of the air outlet valve needle (1) will not be adequate to push the hammer (4) back and therefore the air in the tube is released only once. In such a case, the system does not allow a second shooting and air re-loading is required. The lever limiting notch (28) limits clockwise movement of the lever (3), thus, preventing excessive movement of the hitting surface (18) when coming into contact with the kicking surface (17) of the lever (3).

I claim:

1. A firing system in pre-charged pneumatic (PCP) rifle comprising:

at least one gas piston;

at least one hammer; and at least one lever having at least one kicking surface and at least one needle contact surface, wherein the at least one kicking surface and the at least one needle contact surface are parallel to one another.

2. The firing system of claim 1, wherein the at least one lever has on its upper end, a lever limiting notch.

3. The firing system of claim 1, wherein the at least one lever has on its lower end, a needle limiting notch.

4. The firing system of claim 1, wherein the at least one lever at a lower part of the at least one kicking surface has a pushing surface.

5. The firing system of claim 1, wherein the at least one lever has at least one centering hole.

6. The firing system of claim 4, wherein the at least one kicking surface and the pushing surface face the hammer and the at least one needle contact surface faces the needle.

* * * * *